United States Patent [19]

Cunningham

[11] Patent Number: 4,826,451

[45] Date of Patent: May 2, 1989

[54] MORE DURABLE MODIFIED CONNECTOR FOR NUCLEAR POWER PLANT PRESSURIZER HEATER APPLICATIONS

[75] Inventor: Charles R. Cunningham, Seattle, Wash.

[73] Assignee: General Electric Company, Cincinnati, Ohio

[21] Appl. No.: 131,885

[22] Filed: Dec. 11, 1987

[51] Int. Cl.[4] ..... H01R 4/70

[52] U.S. Cl. ..... 439/589; 439/935; 439/936; 174/152 GM

[58] Field of Search ..... 439/722, 736, 936, 271, 439/276, 587, 589, 935; 174/76, 77 R, 152 GM

[56] References Cited

U.S. PATENT DOCUMENTS

| | | | |
|---|---|---|---|
| 2,688,737 | 9/1954 | Okserka et al. | 439/736 |
| 3,290,639 | 12/1966 | Driemeyer | 439/935 |
| 3,346,836 | 10/1967 | Hellman | 439/736 |
| 3,685,005 | 8/1972 | D'Alessandro | 439/736 |
| 3,721,948 | 3/1973 | Brandt et al. | 439/695 |
| 4,174,145 | 11/1979 | Oeschger et al. | 439/935 |
| 4,335,932 | 6/1982 | Herrmann, Jr. | 439/936 |
| 4,461,925 | 7/1984 | Bowsky et al. | 174/152 GM |
| 4,480,151 | 10/1984 | Dozier | 174/153 R |

*Primary Examiner*—Gary F. Paumen

*Attorney, Agent, or Firm*—Derek P. Lawrence; Nathan D. Herkamp

[57] ABSTRACT

An electrical connector assembly for use with a nuclear power plant pressurizer heater includes an external metal shell having a base end and a connection end with a header located internally of the shell intermediate the two ends. Connector pins extend from end to end of the shell passing through apertures in the header. About the pins there is placed a high voltage insulator such as a ceramic material extending on either side of the header. The base end of the connector is filled with an insulative reinforcement material completely surrounding the pins. The connection end is filled with a granular thermally stable insulative material and closed by connection to a heater assembly. The base end of the connector may also include an external flexible covering of insulative material to further protect the pins and reinforcement material from hydroscopic contamination.

3 Claims, 3 Drawing Sheets

MORE DURABLE MODIFIED CONNECTOR FOR NUCLEAR POWER PLANT PRESSURIZER HEATER APPLICATIONS

This invention relates to hermetically sealed power connectors and, more particularly, to a connector adapted for use with nuclear power plant pressurizer heaters.

Power connectors for most applications are designed only to provide sufficient electrical insulation resistance to prevent electrical breakdown. However, many nuclear power plant requirements dictate not only exceptional electrical breakdown characteristics but also stringent thermal capability, radiation resistance, mechanical shock resistance and ability to withstand repeated inspections. The present invention is directed to a connector system for a pressurizer heater in a nuclear power generating facility. Such pressurizer heaters are positioned within sealed water containing vessels for the purpose of heating the water to a temperature and pressure sufficient to generate steam. An electrical connector for use with such heaters is required to withstand temperatures of 450 degrees Farenheit for long periods of time without any significant irreversible decrease in insulation resistance due to aging effects. Typically, such connectors will have at least 200 megohm of insulation resistance, be capable of operating as high as 575 volts, be capable of withstanding as high as 2150 volts to ground without breakdown, have reinforcement material with excellent dimensional stability and high impact (shock) resistance.

SUMMARY OF THE INVENTION

It is an object of the present invention to provide an improved power connector for a pressurizer heater.

It is another object to provide an improved power connector which has relatively high mechanical shock resistance.

It is yet another object to provide an improved power connector which minimizes the use of exposed ceramic insulators.

The above and other objects are achieved in a connector assembly for a pressurizer heater in which the connector assembly includes an outer cylindrical metal shell having a connection end for attachment to the heater, a base end for connection to an electrical power source and a metal header intermediate the base and connection ends internally of the shell. A pair of power carrying connector pins extend through the shell, from base end to connection end, through apertures in the header. Each pin is surrounded by a substantially rigid high-voltage insulator adjacent the header, the insulator substantially filling the space between each of the pins and the adjacent sides of the header aperture and extending a predetermined distance on each side of the header. A metal lug is brazed or welded to an end of each pin at the base end of the connector to enable connection of the pin to a source of electrical power. Each lug has a portion deformed into a non-planar configuration for accommodating inadvertent mechanical expansion in order to reduce excessive force on the pin connection. An insulative reinforcement material is molded or cast into the base end of the shell surrounding the pin portions therein and the pin-to-lug connection points and filling the shell. Since the non-planar portion of each lug protrudes from the shell wall, slots are formed on opposing sides of the shell. During molding or casting of the fill material, a dam is used to prevent the material from flowing out of the shell. The shell is also formed with a circumferential external ring approximately centrally thereof. A flexible insulative boot can be placed about the base end of the shell covering the lugs and retained in place about the circumferential ring. The connection end of the shell is adapted to be welded to a heater housing when the pin is connected to the heater.

DESCRIPTION OF THE DRAWINGS

For a better understanding of the present invention, reference may be had to the following detailed description taken in conjunction with the accompanying drawings in which.

DETAILED DESCRIPTION

Figure 1B:
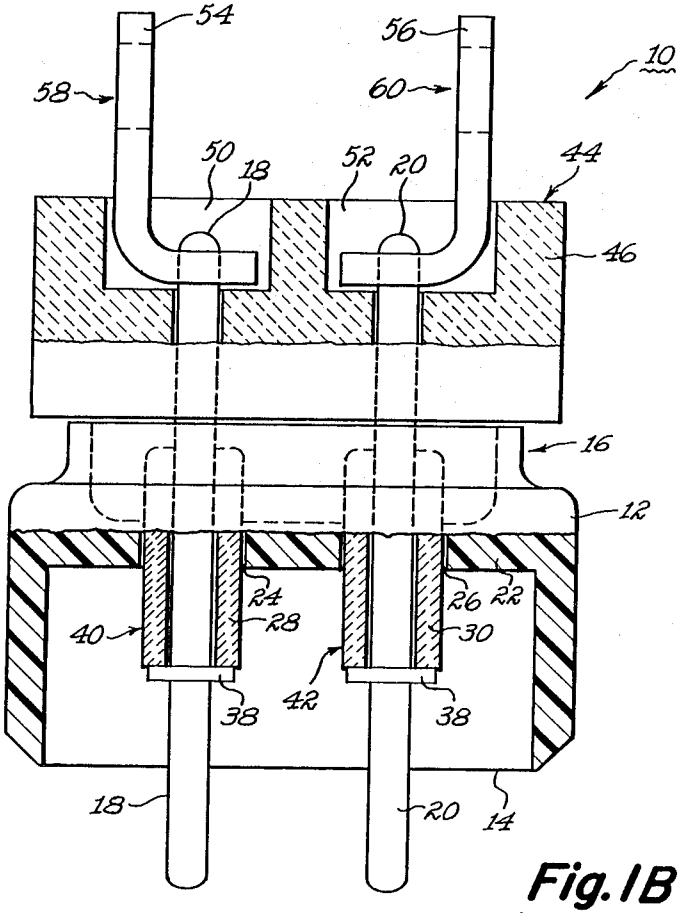
Fig. 1B (PRIOR ART)
FIGS. 1A and 1B illustrate partial section and phantom views of a prior art power connector with the connector rotated 90 degrees between views.
Figure 1A:
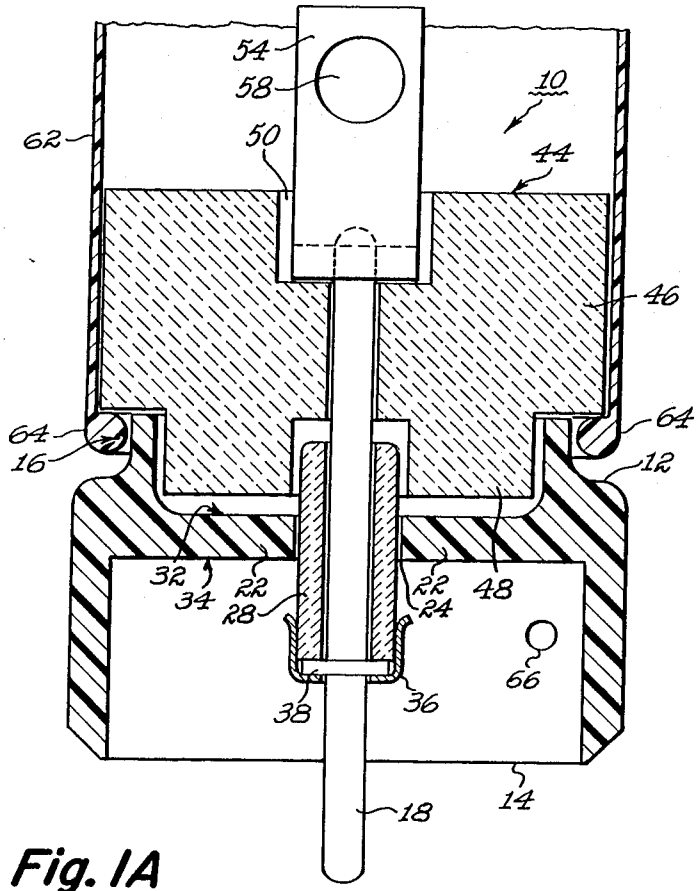
Fig. 1A (PRIOR ART)

FIGS. 1A and 1B illustrate one form of prior art connector for nuclear power plant pressurizer heaters. The connector indicated generally at 10 comprises an outer metal shell 12 extending from a connection end 14 of connector 10 to a reduced diameter area 16 approximately midway thereof. First and second electrically conductive power pins 18,20 extend through shell 12, extending substantially beyond end 14 and area 16. Within shell 12 there is a header 22 having first and second apertures 24,26 through which pins 18,20 pass, respectively. Surrounding each of the pins 18,20 adjacent header 22 are corresponding electrical insulators 28,30. The insulators 28,30 extend beyond both sides 32,34 of header 22 a distance sufficient to prevent electrical breakdown from pins 18,20 to shell 12. The insulators 28,30 extend further toward connection end 14 so that caps or sleeves 36 can be brazed to each insulator. Each pin 18,20 has a flange 38 approximately the same diameter as the outside diameter of each of the insulators 28,30. The sleeves 36 fit over the pins 18,20 capturing flanges 38 against an end of insulators 28,30. The outside surface of each insulator end 40,42 is metallized so that the sleeves 36 can be brazed to the insulators to hold the pins 18,20 in fixed position. The insulators 28,30 are also metallized adjacent the surface passing through the header 22. Insulators 28,30 can be brazed to the header 22.

The end of the connector 10 distal from the connection end 14 is referred to herein as the base end 44. In the illustrative prior art connector, the base end 44 comprises a ceramic insulator 46 having a reduced diameter area 48 which fits within area 16 of shell 12 and abuts against the adjacent side of header 22. The insulator 46 extends from the area 16 to beyond the base ends of pins 18,20. The diameter of the extended insulator 46 area is slightly less than the diameter of shell 12. The insulator 46 has recessed areas 50,52 adjacent each pin end which allows each pin to be welded to a corresponding lug 54,56. The lugs 54,56 are typically heavy gauge copper formed in substantially an L-shape. The lugs allow connection to an external power source (not shown) by use of bolts through apertures 58,60. The assembled connector 10 generally includes an outer rubber boot 62 having a ribbed edge 64 which fits about area 16. The boot 62 extends over the external insulator 46 and the lugs 54,56 to provide additional environmental protection to the connector.

When the connector 10 is attached to a heater (not shown), the connection end 14 is closed by the heater housing. Within the wall of shell 12 there is provided a small hole 66 which enables the connection end of the connector to be filled, between header 22 and the heater, with granular MgO to provide a thermally stable and electrically insulative material about pins 18,20. Once the granules of MgO have been poured into shell 12, the hole 66 is welded shut within an inert gas pressurized chamber. Generally, a screw (not shown) is placed into a hole 66 prior to welding in order to minimize the required weld build-up for closure.

It has been found that improper handling of the above described connector 10 may result in cracking and or breakage of the external ceramic insulator 46 and also the internal ceramic insulators 28,30. Cracking or breakage of either insulator may result in electrical breakdown of the connector. If both insulators are damaged, the MgO granules may escape from the connector and contaminate the area in which the connector is located. Still further, insulator failure may provide a leak path for primary coolant out of the pressurizer in the event of heater sheath wall rupture.

Figure 2B:
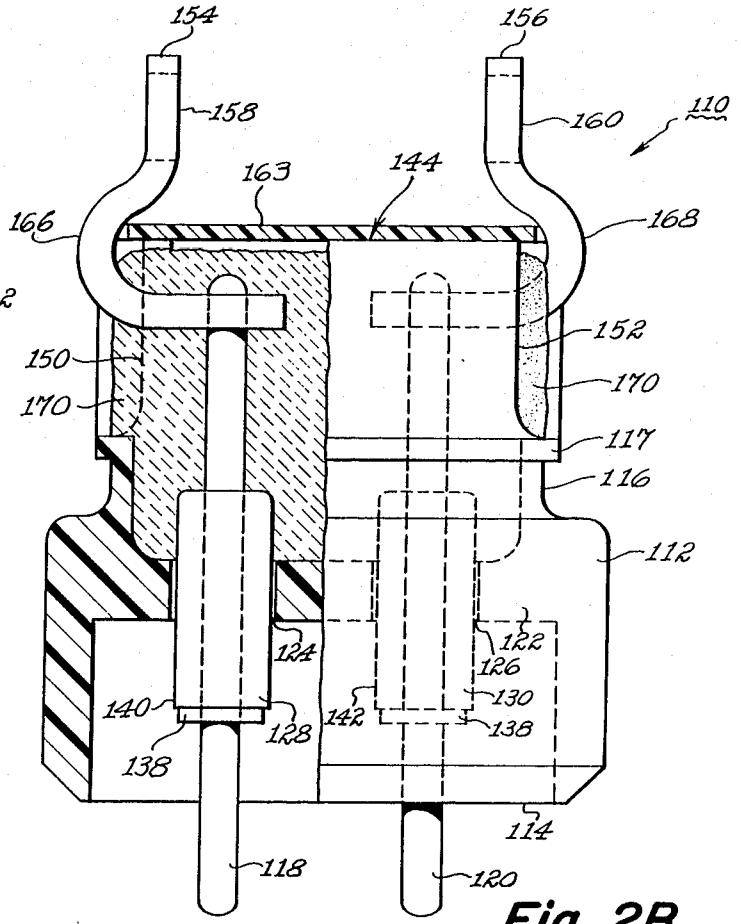
FIGS. 2A and 2B illustrate partial section and partial phantom views of a power connector in accordance with the present invention rotated 90 degrees between views.
Figure 2A:
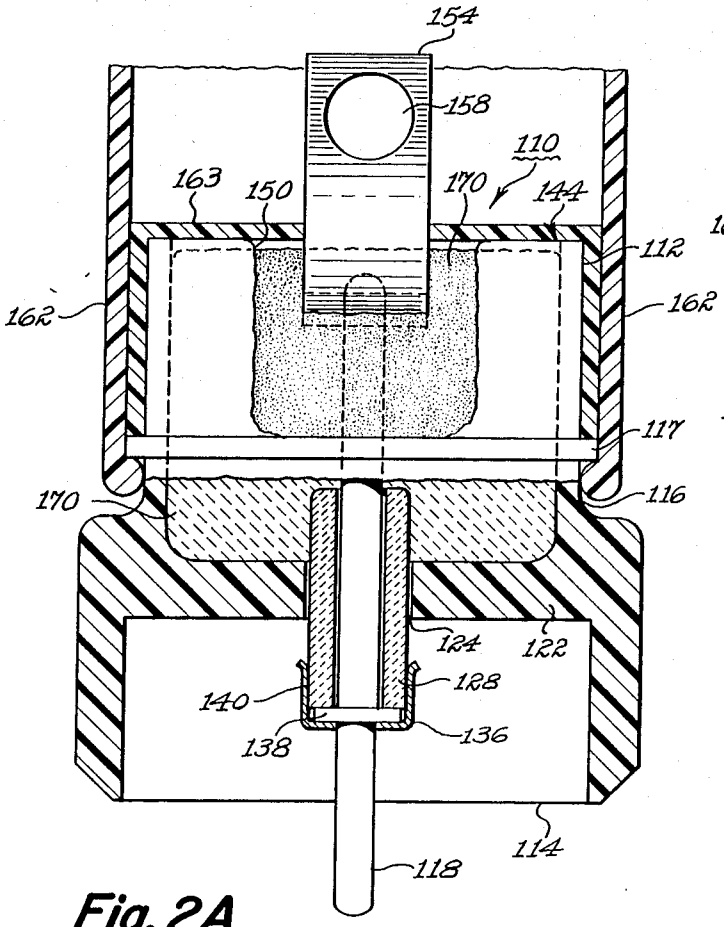

The connector according to the present invention obviates many of the above noted problems by increasing the size of the outer shell 12 and by eliminating the external ceramic insulator 46. Referring now to FIGS. 2A and 2B, there is shown a pressurizer heater connector 110 having an outer metal shell 112 extending from a connection end 114 to a base end 144. The shell 112 has a reduced diameter area 116 which begins approximately midway thereof. A ring 117 extending circumferentially around the shell 112 defines an area for latching an insulative boot 162 over the base end of the connector. First and second electrically conductive power pins 118,120 extend through shell 112, extending substantially beyond end 114 and terminating slightly below end 144. Within shell 112 there is a header 122 unitary with said shell 112 having first and second apertures 124,136 through which pins 118,120 pass, respectively. Surrounding each of the pins 118, 120 adjacent header 122 are corresponding electrical insulators 128,130. The insulators 128,130 extend beyond both sides of header 122 a distance sufficient to prevent electrical breakdown from pins 118,120 to shell 112.

The insulators 128,130 extend further toward connection end 114 so that caps or sleeves 136 can be brazed to each insulator. Each pin 118,120 has a flange 138 approximately the same diameter as the outside diameter of each of the insulators 128,130. The sleeves 136 fit over ends 118,120 capturing flanges 138 against an end of insulators 128,130. The outside surface of each insulator end 140,142 is metallized so that the sleeves 136 can be brazed to the insulators to hold the pins 118,120 in fixed position. The insulators 128,130 are also metallized adjacent the surface passing through the header 122 so that the insulators can be brazed to the header 122.

That portion of the connector 110 between ring 117 and base end 144 is provided with opposing slots 150,152. The slots extend from the end 144 to substantially the ring 117. The width of the slots is approximately twice the width of metal lugs 154,156 which are attached by brazing to the ends 118,120, respectively. Each of the copper lugs 154,156 includes apertures 158,160, respectively, for connecting the lugs by bolts (not shown) to a source of electrical power. Each of the lugs 154,156 also has a portion 166,168 between the connections to pins 118,120 and the apertures 158,160 which is deformed into a non-planar configuration for accommodating inadvertent mechanical expansion in order to reduce excessive force transmitted to each of the connection pins 118,120. The deformed portions 166,168 extend outward of the shell slightly passing through the slots 150,152. The portion of the connector 110 between the header 122 and the end 144 is filled with a suitable plastic or plastic composite, rubber, ceramic, or combination of such reinforcement material 70 which is either molded or cast in place. The reinforcement material 170 extends over the connection points between the pins 118,120 and the corresponding lugs 154,156. However, the material 170 does not extend beyond the end 144 of the shell 112.

The outer shell 112, which is preferably formed of austenitic stainless steel, extends sufficiently above the top of the connector pins 118 and 120 so as to act as the primary barrier to vertical and horizontal impact forces. The reinforcement material 170 is molded or cast into the external cavity defined by the extended portion of the shell 112 and surrounds the electrical conductor connections and fits tightly about the internal ceramic insulators 128 and 130 at least covering those portions extending through the header 122 towards the base end 144. The material 170 provides a secondary hermetic seal to back up the primary ceramic to metal seal formed by insulators 128,130. The material 170 also provides a seal that prevents a spillage of granular magnesium oxide (MgO) through a broken ceramic to metal primary seal which may occur in the event of a shock to the connector sufficient to crack the insulators 128,130. It should also be noted that it is possible to fill the cavity at the connection end of the shell 112 with similar reinforcement material, if such material will provide the same degree of thermal and electric insulative capabilities as MgO. The connector will also be provided with a suitable molded rubber coating, 163. The coating is effective to reduce moisture absorption, improve insulation resistance degradation, and provide proper clearance between electrical conductors and ground.

The expansion and contraction capability created in the copper lugs 154,156 by the non-planar deformation portion 166 and 168 reduces the external force transmission to the connection pins 118, 120. This further reduces the stress transmitted from the connection pins to the ceramic insulators which reduces the likelihood of stress fracture of the ceramic insulators 128,130.

The connector design of the present invention eliminates the external ceramic insulator and negates the direct force transmission through the connection pins to the inner ceramic insulators. In addition, the reinforcement material 170 represents a backup hermetic seal in the event that the primary seal breakage occurs in the internal ceramic insulators 128,130. The backup seal 170 also prevents a spillage of granular MgO and contamination of the reactor facility.

Figure 3:
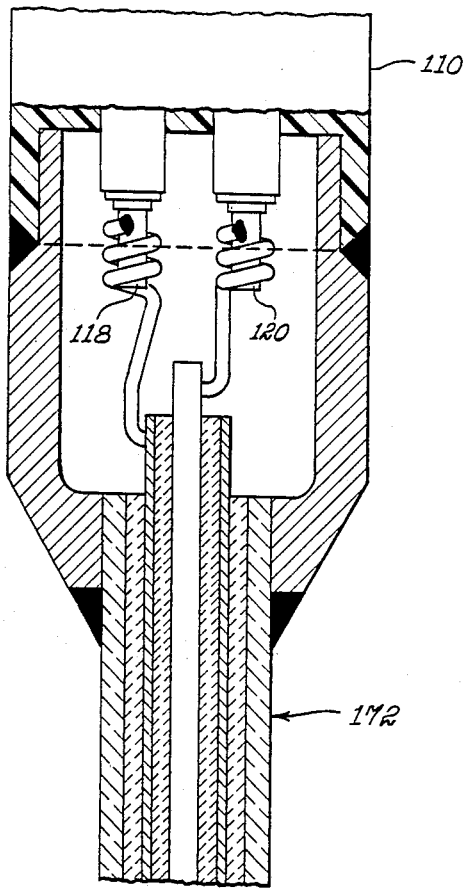
FIG. 3 illustrates a power connector in conjunction with a pressurizer heater.

FIG. 3 is a simplified drawing of a connector 110 in accordance with the present invention in operative connection to a pressurizer heater 172.

While the present invention has been described in what is considered to be the preferred embodiment, other modification and variations may become apparent to those skilled in the art. Accordingly, it is intended that the invention be interpreted with a scope commensurate with the appended claims.

What is claimed is:

1. An electrical connector assembly comprising: an external metal shell having a connection end, a base end and a header inside of said shell and unitary therewith intermediate said connection end and said base end;

at least one connector pin extending through said header from said base end to said connection end of said shell;

at least one aperture penetrating said header for passage of said at least on pin; a substantially rigid high voltage insulator surrounding said connector pin at said header, said insulator extending through said header a predetermined distance on each side thereof;

and insulative reinforcement material substantially filling said base end of said shell surrounding said pin;

means for filling said connection end with a thermally stable high voltage insulative material surrounding said pin; and a metal lug brazed to said pin at said base end for enabling connection of said pin through said lug to a source of electrical power, said lug having a portion thereof between said pin and the source deformed into a non-planar configuration for accommodating inadvertent mechanical expansion in order to reduce excessive force transmitted to said pin.

2. The connector of claim 1 wherein said base end of said shell includes a slot extending toward said header, said slot being wider than said lug and said non-planar portion of said lug extending slot.

3. The connector of claim 2 wherein the base end extends on each side of the slot sufficiently over the top of the reinforcement material to act as a primary barrier to horizontal and vertical impact forces.

* * * * *